US011896916B2

(12) United States Patent
Zachry

(10) Patent No.: US 11,896,916 B2
(45) Date of Patent: Feb. 13, 2024

(54) INFANT TUMMY TIME KIT

(71) Applicant: UNIVERSITY OF TENNESSEE RESEARCH FOUNDATION, Knoxville, TN (US)

(72) Inventor: Anne H. Zachry, Germantown, TN (US)

( * ) Notice: Subject to any disclaimer, the term of this patent is extended or adjusted under 35 U.S.C. 154(b) by 218 days.

(21) Appl. No.: 17/559,026

(22) Filed: Dec. 22, 2021

(65) Prior Publication Data

US 2022/0193569 A1 Jun. 23, 2022

Related U.S. Application Data

(60) Provisional application No. 63/129,043, filed on Dec. 22, 2020.

(51) Int. Cl.

| | |
|---|---|
| ***A63H 33/00*** | (2006.01) |
| ***A47D 15/00*** | (2006.01) |
| ***A47D 13/08*** | (2006.01) |

(52) U.S. Cl.

CPC ..... *A63H 33/006* (2013.01); *A47D 13/08* (2013.01); *A47D 15/003* (2013.01)

(58) Field of Classification Search

CPC ..... A47D 15/003; A47D 15/005; A47G 2009/1018; A47C 27/146; A63H 33/006

See application file for complete search history.

(56) References Cited

U.S. PATENT DOCUMENTS

| | | | | |
|---|---|---|---|---|
| 4,607,403 | A * | 8/1986 | Alivizatos | A47D 15/003 5/636 |
| 5,014,376 | A * | 5/1991 | Doran | A47D 15/008 5/655 |
| 5,341,531 | A * | 8/1994 | Straub | A47D 15/008 5/655 |
| 7,107,639 | B2 * | 9/2006 | Taricani | A47D 13/08 5/915 |
| 8,341,782 | B2 | 1/2013 | Abrahams | |
| 8,795,023 | B2 | 8/2014 | Elson | |
| 2006/0016013 | A1 * | 1/2006 | Lord | A47D 15/008 5/655 |

(Continued)

OTHER PUBLICATIONS

Infantino Brand Commercially Available Tummy Time Mats, 4 pages, available at least as of Sep. 25, 2020.

(Continued)

*Primary Examiner* — John A Ricci

(74) *Attorney, Agent, or Firm* — FisherBroyles, LLP; Susan M. Oiler

(57) ABSTRACT

A tummy time support for infants has a wedge-shaped support having a flat bottom surface, a top surface inclined at a first angle in a range of about 8° to about 20° relative to the bottom surface, a front side at the peak of the incline, a rear side at the base of the incline. In a top view thereof, the front side has two concave recesses positioned proximate shoulder positions of an infant and the rear side has a single elongate concave recess with a peak centered between the two concave recesses. Kits are disclosed that have of a mat having a first fastener and a first tummy time support having a second faster releasably mutable to the first fastener. The kit can include a toy support and a second tummy time support that is bigger or smaller than the first tummy time support.

19 Claims, 9 Drawing Sheets

```
. anova time condition respondent, repeated(condition)

                   Number of obs =      63    R-squared     = 0.7238
                   Root MSE      = 22.2475    Adj R-squared = 0.5718
```

| Source | Partial SS | df | MS | F | Prob>F |
|---|---|---|---|---|---|
| Model | 51874.857 | 22 | 2357.9481 | 4.76 | 0.0000 |
| condition | 8884.6667 | 2 | 4442.3333 | 8.98 | 0.0006 |
| respondent | 42990.19 | 20 | 2149.5095 | 4.34 | 0.0000 |
| Residual | 19798 | 40 | 494.95 | | |
| Total | 71672.857 | 62 | 1156.0138 | | |

```
Between-subjects error term:  respondent
                     Levels:  21          (20 df)
     Lowest b.s.e. variable:  respondent

Repeated variable: condition

                              Huynh-Feldt epsilon        = 0.9993
                              Greenhouse-Geisser epsilon = 0.9125
                              Box's conservative epsilon = 0.5000
```

| | | | Prob>F | | | |
|---|---|---|---|---|---|---|
| Source | df | F | Regular | H-F | G-G | Box |
| condition | 2 | 8.98 | 0.0006 | 0.0006 | 0.0009 | 0.0071 |
| Residual | 40 | | | | | |

(56) References Cited

U.S. PATENT DOCUMENTS

2012/0325881 A1* 12/2012 White ..... A63H 33/006
224/581
2020/0121253 A1* 4/2020 López Martínez .... A61B 5/704

OTHER PUBLICATIONS

Splashin'kids Inflatable Tummy Time mat, pp. 11, available at least as of Sep. 2018.

* cited by examiner

```
. anova time condition respondent, repeated(condition)

                  Number of obs =      63    R-squared     = 0.7238
                  Root MSE      = 22.2475    Adj R-squared = 0.5718
```

| Source | Partial SS | df | MS | F | Prob>F |
|---|---|---|---|---|---|
| Model | 51874.857 | 22 | 2357.9481 | 4.76 | 0.0000 |
| condition | 8884.6667 | 2 | 4442.3333 | 8.98 | 0.0006 |
| respondent | 42990.19 | 20 | 2149.5095 | 4.34 | 0.0000 |
| Residual | 19798 | 40 | 494.95 | | |
| Total | 71672.857 | 62 | 1156.0138 | | |

```
Between-subjects error term:  respondent
                     Levels:  21        (20 df)
     Lowest b.s.e. variable:  respondent

Repeated variable: condition

                              Huynh-Feldt epsilon        = 0.9993
                              Greenhouse-Geisser epsilon = 0.9125
                              Box's conservative epsilon = 0.5000
```

| | | | Prob>F | | | |
|---|---|---|---|---|---|---|
| Source | df | F | Regular | H-F | G-G | Box |
| condition | 2 | 8.98 | 0.0006 | 0.0006 | 0.0009 | 0.0071 |
| Residual | 40 | | | | | |

FIG. 14

```
. estat esize, omega

Effect sizes for linear models
```

| Source | Omega-squared | df |
|---|---|---|
| Model | .5679258 | 22 |
| condition | .2705761 | 2 |
| respondent | .5229069 | 20 |

```
Note: Omega-squared values for individual
      model terms are partial.

. pwcompare condition, mcompare(sidak) pveffects

Pairwise comparisons of marginal linear predictions

Margins: asbalanced
```

| | Number of comparisons |
|---|---|
| condition | 3 |

Positions: Blanket; C-shaped Pillow; Invention

| | Time(seconds) Contrast | Std. err. | Sidak t | P>\|t\| |
|---|---|---|---|---|
| condition | | | | |
| Blanket vs. C-shaped Pillow | 9.095238 | 6.865719 | 1.32 | 0.474 |
| Invention vs. C-shaped Pillow | 28.47619 | 6.865719 | 4.15 | 0.001 |
| Invention vs. Blanket | 19.38095 | 6.865719 | 2.82 | 0.022 |

FIG. 15

INFANT TUMMY TIME KIT

RELATED APPLICATIONS

This application claims the benefit of U.S. Provisional Application No. 63/129,043, filed Dec. 22, 2020, the entirety of which is incorporated herein by reference.

TECHNICAL FIELD

This application relates to an infant tummy time kit, more particularly, a kit having a mat having a first fastener on a top surface and a first and a second wedge-shaped supports, each having a fastener releasably connectable to the first fastener and the second wedge-shaped support having a steeper incline than the first wedge-shaped support.

BACKGROUND

The American Academy of Pediatrics (AAP) recommends at least 30 minutes of tummy time per day to provide opportunities to facilitate motor milestone development and to prevent flat spots from developing on infants' heads. Research suggests that many parents are not aware of the tummy time recommendation or the potential complications that can occur from limited tummy time. For example, in a study that included 135 parents, 53% reported that their infants received less than 30 minutes of tummy time a day and 35% were intolerant of the prone position.

Tummy time on a blanket on the floor, as shown in FIG. 10, lacks chest support for infants to relieve the strain on muscles as they develop muscles to support their head. As such, parents often turn to commercially available products promoted for improved tummy time. Many of the commercially available tummy time products use a "prop pillow," which is a half-circle-shaped pillow that is supposed to provide support during tummy time. Unfortunately, prop pillows can put unnecessary pressure on an infant's armpit area or axilla, which contains sensitive nerves, lymph nodes, and blood vessels. Also, as seen in FIG. 11, the infant is often found to be resting their chin on the pillow, which requires no head control. The pillow also prevents weight bearing on elbows or hands and has a potential to block the infant's airway if the head is resting on the pillow.

Thus, there is a need for a tummy time product that will make tummy time a more comfortable, taking the stress off the armpit area and axilla, and providing an enjoyable experience for the baby while promoting motor skill development.

SUMMARY

In all aspects, infant tummy time kits are disclosed herein that include a mat having a first fastener fixedly attached to a top surface thereof and a first wedge-shaped support having a second fastener fixedly attached to a bottom surface thereof that is releasably attachable to the first fastener. The first wedge-shaped support has a top surface inclined at a first angle in a range of about 8° to about 20° relative to the bottom surface, has an inward arcuate recess generally centrally in a rear surface, and has two inward arcuate recesses in a front surface. In a top view, one of the two inward arcuate recesses is positioned to the left and the other is position to the right of the peak of the inward arcuate recess. The incline begins at the rear surface and extends to the front surface in a central region of the first wedge-shaped support.

The kit can include a second wedge-shaped support that has a third fastener fixedly attached to a bottom surface thereof and has a top surface inclined at a second angle. The third fastener is releasably attachable to the first fastener, and the second angle is in the range of about 8° to about 20° relative to the bottom surface and is at an angle that is greater than the first angle. The mat can have a fourth fastener fixedly attached to the top surface thereof and positioned a pre-selected distance from a position of a leading edge of the first wedge-shaped support when attached to the mat, and the kit can include a toy support having a fifth fastener fixedly attached to a bottom surface thereof. The fifth fastener is removably attachable to the fourth fastener to attach the toy support to the mat. The toy support has a first major side that can have one or a plurality of connectors fixedly attached thereto that are each connectable to a toy. The toy support can include a non-breakable mirror on an opposite side from the first major side or on the first side. The toy support is attachable to the fourth fastener with either the first major side or the opposite side facing whichever of the first and second wedge-shaped supports is attached to the first fastener.

In some embodiments, the toy support is wedge-shaped, and the first major side is a sloped incline oriented to position a top of the toy support further from the first or second wedge-shaped support, and the opposite side is a vertically upright surface.

In all embodiments, the fasteners can be snaps, hook-and-loop fasteners, magnets, zippers, carabiner clips, and/or strings and laces.

In all embodiments, the wedge-shaped supports each have a removably replaceable jacket thereover and the body comprises a foam material.

In all embodiments, the top surface of each wedge-shaped support is contoured at the leading edge to define a left arm trough and a right arm trough, thereby giving the top surface an undulating contour along the length thereof, the length being oriented transverse to the direction of the incline. Each wedge-shaped support has opposing flanges protruding vertically upward from the top surface running from the leading edge to the trailing edge at positions proximate a left side and a right side, respectively. The opposing flanges are arcuate toward the interior of the top surface and provide crests to the undulating contour thereof.

In one embodiment, the kit includes a spacer removably attachable to the mat at a position to space an infant's legs apart. The leg spacer is generally triangularly-shaped.

In another aspect, a tummy time support for infants is disclosed that has a wedge-shaped support having a flat bottom surface, a top surface inclined at a first angle in a range of about 8° to about 20° relative to the bottom surface, a front side at the peak of the incline, a rear side at the base of the incline. In a top view, the front side has two concave recesses positioned proximate shoulder positions of an infant on its tummy and the rear side has a single elongate concave recess with a peak centered between the two concave recesses in the front side. The top surface is contoured at the leading edge to define a left arm trough and a right arm trough, thereby giving the top surface an undulating contour along the length thereof, the length being oriented transverse to the direction of the incline.

In all aspects, the support has opposing flanges protruding vertically upward from the top surface running from the leading edge to the trailing edge at positions proximate a left side and a right side, respectively. The opposing flanges are arcuate toward the interior of the top surface and provide crests to the undulating contour thereof. The height at the leading edge is in a range of about 1 inch to about 1.5 inches and the height at the trailing edge is in a range of about ¼ inch to about % inch. A width measured at the center of the wedge-shaped support is in a range of about 3 inches to about 4 inches and a length of the wedge-shaped support is in a range of about 12 inches to about 17 inches.

BRIEF DESCRIPTION OF THE DRAWINGS

FIG. 14 is an output of ANOVA analysis of the time spent prone in an infant study.

FIG. 15 is an additional output of the analysis of time spent prone by infants in the infant study.

DETAILED DESCRIPTION

Figure 1:
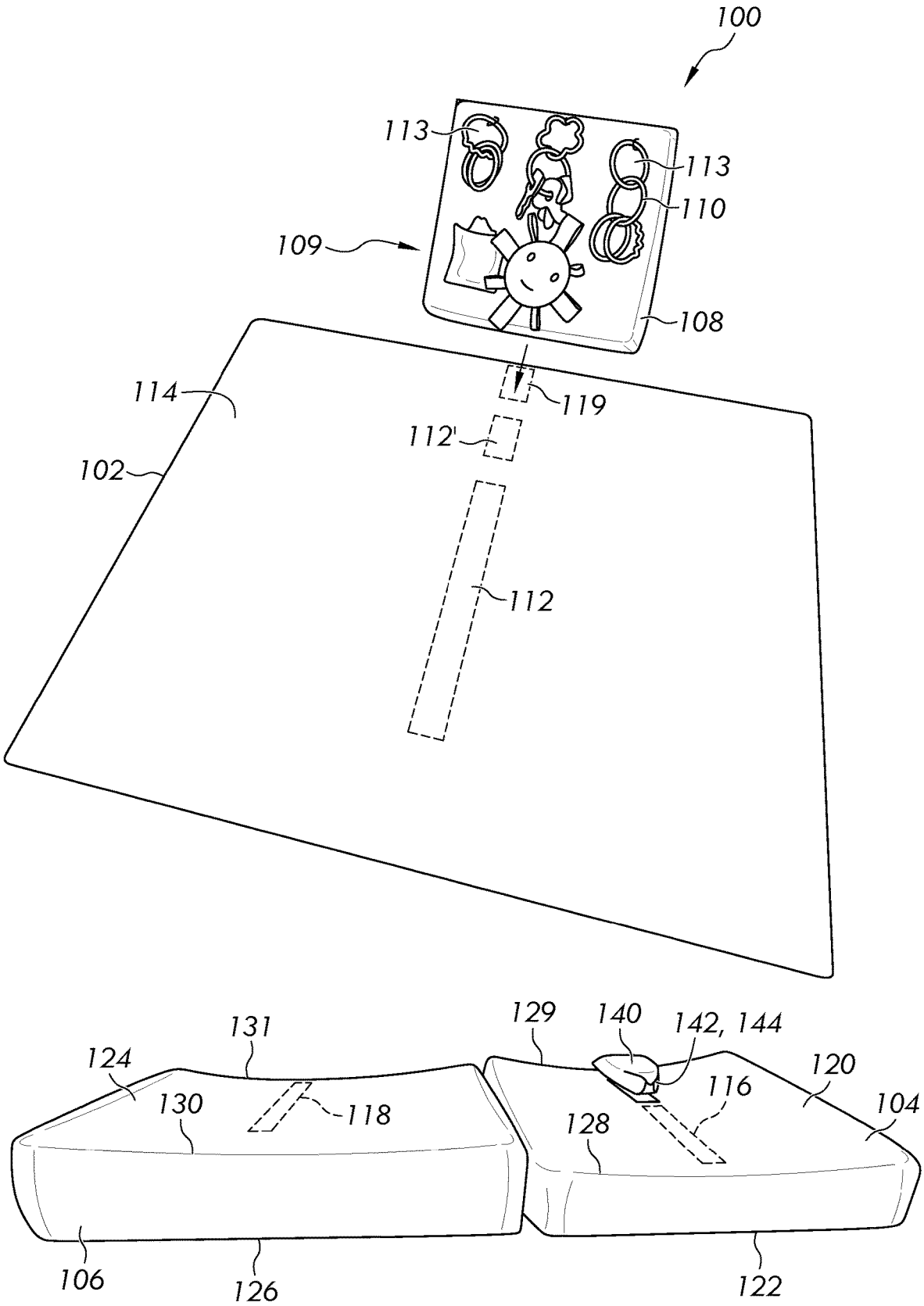
FIG. 1 is a photograph from a top perspective view of a mat having a first fastener and having a toy support releasably attached to a second fastener and front perspective views of first and second wedge-shaped supports releasably attachable to the first fastener.

The following detailed description will illustrate the general principles of the invention, examples of which are additionally illustrated in the accompanying drawings. In the drawings, the same reference numbers indicate identical or functionally similar elements.

"About" as used herein means any measurement within a +/−0.5 of the increment specified. For measurements in inches, "about" means within +/−0.25 inch of the increment specified.

Referring generally to FIGS. 1-9, the tummy time kit 100 is a fun and entertaining tummy time system that will grow with an infant. The system includes a mat 102 having one or two releasably attachable wedge-shaped supports 104, 106 or 204 of different sizes (inclines and shape) and a toy support 108 that can be outfitted with developmentally stimulating multi-sensory toys 110 and a non-breakable mirror 111 (shown in FIGS. 4 and 9). In one embodiment, the mat 102 is a blanket. Each wedge-shaped support 104, 106, 204 comprises foam, in particularly the top surface 121, 123, 221 respectively, (under the jackets 120, 124, 220) is made of foam that is form-fitting to the infant's body and positions the infant at an incline, which shifts the infant's weight toward the lower back and hips (away from the armpits) and makes it easier for the infant to hold his/her head in an upright position. The first and second wedge-shaped supports 104, 106 are contoured to allow for weight-bearing through the elbows, arms, and hands, which is important for motor skill development.

Figure 9:
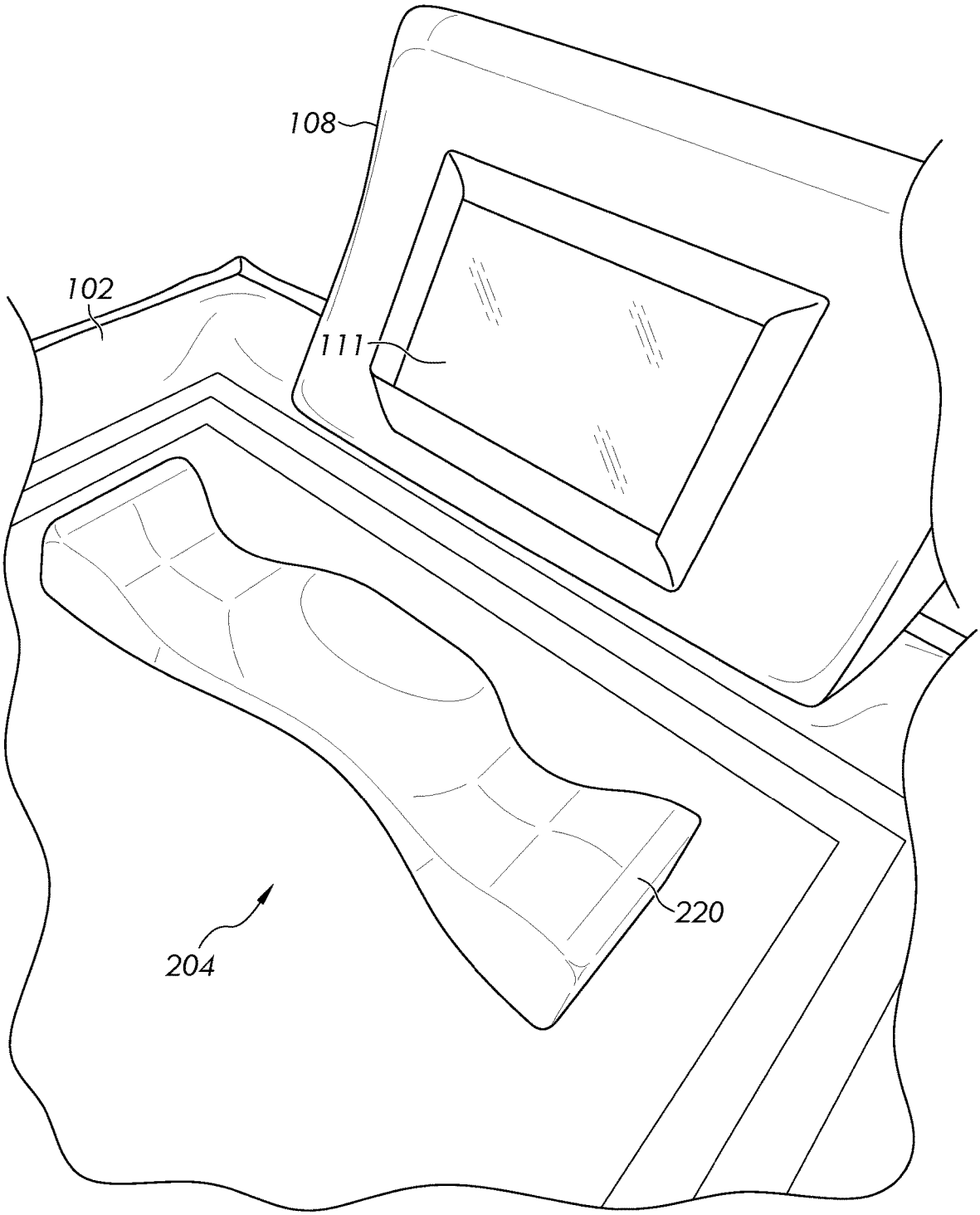
FIG. 9 is a kit having a mat, the wedge-shaped support of FIG. 6 inside a jacket and a toy support.

Turning now to FIGS. 1 and 9, the kit 100 includes the mat 102 which has a first fastener 112 or 112' depending upon which shaped support is provided therewith, represented by a first dashed box and a second dashed box, on a top surface 114 thereof. The mat 102 can include one or more first connectors 113*a*, shown in FIG. 4, for a toy fixedly attached to the top surface of the mat in the space between the position of the leading edge 128 of the wedge-shaped support 106 and the fourth fastener, which is releasably mated to the toy support 108. The kit has a first wedge-shaped support 104 or 204 having a second fastener 116 on a bottom surface 122 thereof (represented by a second dashed box in the lower half of FIG. 1), and a second wedge-shaped support 106 having a third fastener 118 on a bottom surface 126 thereof, represented by a third dashed box. The dashed boxes 116, 118 may appear to be on a top surface of the wedge-shaped supports in the drawings, but the dashed boxes are meant to represent that the fasteners are on a bottom surface 122, 126, respectively, of the wedge-shaped-supports, such that the fasteners mate to connect either wedge-shaped support 104, 106 to the first fastener 112 of the mat 102. The second fastener 116 and the third fastener 118 are each releasably attachable to the first fastener 112. The fasteners 112 and 116, 118 can be snaps, hook-and-loop fasteners, magnets, zippers, carabiner clips, or strings and lacing holes.

For embodiments, where the first and/or second wedge-shaped support is used without the mat 102, the bottom surface may be a slip resistant fabric or grip fabrics, such as MEGA GRIP™ fabric made by TVF, PVC dotted fabrics, textured neoprene fabric.

Figure 4:
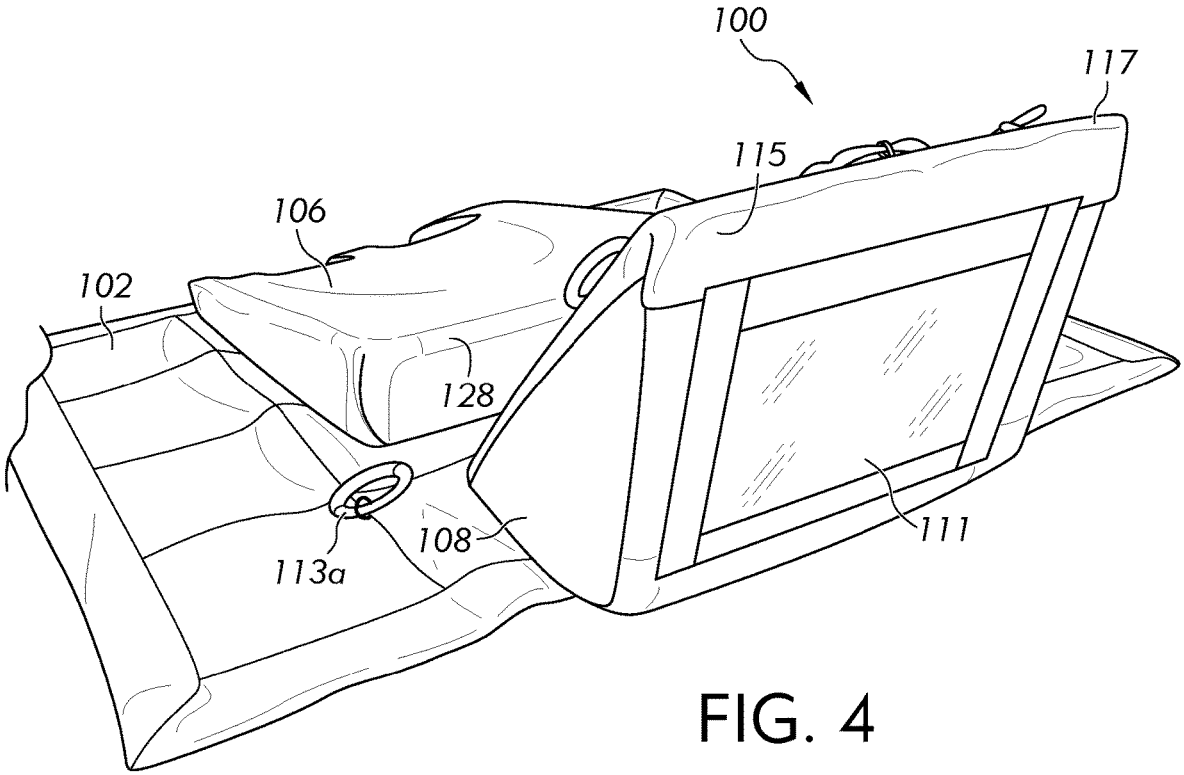
FIG. 4 is a photograph of one variation of the kit from the rear perspective of the toy support.

Referring now to FIGS. 1 and 4, the mat 102 has a fourth fastener 119 on the top surface 114 thereof positioned a pre-selected distance from a position of a leading edge 128 or 130 of the first or second wedge-shaped support 104, 106 when attached to the first fastener 112 of the mat 102. The kit 100 can include a toy support 108 having a fifth fastener on a bottom surface thereof (not shown in the figures). The fifth fastener is removably attachable to the fourth fastener and may be any of the fasteners listed above for the first, second and third fasteners. The toy support 108 has a first major side 109 comprising one or a plurality of connectors 113 each connectable to a toy 110. The toy(s) 110 can be included in the kit or provided by the caregiver of the infant. The toy support 108 has a non-breakable mirror 111 on an opposite side 115 relative to the first major side 109. The toy support 108 is attachable to the fourth fastener with either the first major side 109 or the opposite side 115 facing whichever of the first and second wedge-shaped supports 104, 106 is attached to the first fastener 112. The toy support 108 is wedge-shaped and the first major side 109 is the sloped incline of the wedge-shape, thereby placing the top 117 of the toy support further from the first or second wedge-shaped support 104, 106. The opposite side 115 is a vertically upright surface.

Figure 2:
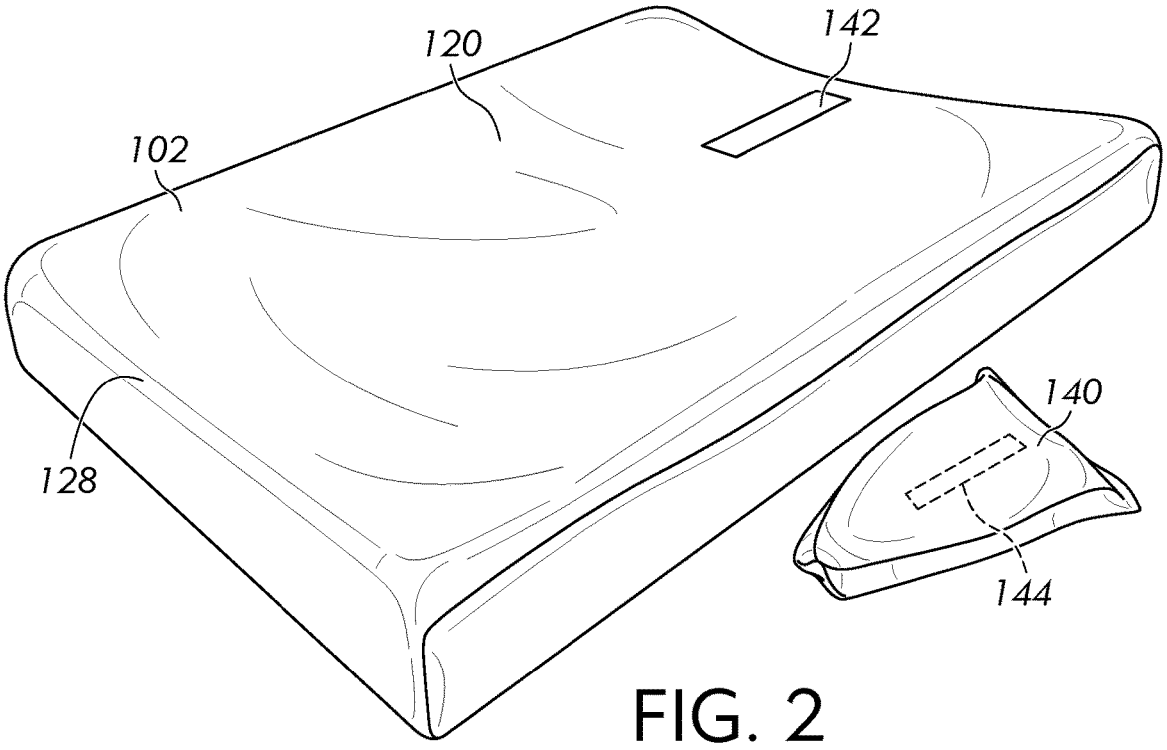
FIG. 2 is photograph from a left side perspective view of the first wedge-shaped support with the spacer removed and placed there beside.

Referring now to FIGS. 1 and 2, the first wedge-shaped support 104 has a top surface 120 inclined at a first angle in a range of about 8° to about 12° relative to the bottom surface 122. This support 104 is intended for infants in a range of birth to 12-14 pounds. The second-wedge shaped support 106 has a top surface 124 included at a second angle in a range of about 15° to about 20° relative to the bottom surface 126. This support 106 is intended for infants in a range of 14+ pounds or more. In the kit 100, the second angle is greater than the first angle and the first wedge-shaped support 104 has a removable, releasably attachable spacer 140 attached to the top surface 120 which is positioned to space an infant's legs apart from one another. As shown in FIG. 2, the releasably attachable spacer 140 may be attachable to the top surface 120 of the first wedge-shaped support 104 by snaps, hook-and-loop fasteners, zippers, magnets, carabiner clips, or strings and lacing holes, i.e., mateable sixth fastener 142 and seventh fastener 144. The leg spacer 140 is generally triangularly-shaped and may have a jacket covering a body defining said shape. The apex of the triangular shape points toward the leading edge of the first wedge-shaped support. The first wedge-shaped support 104 has a central concave region in the top surface proximate the position of the leg spacer 140.

The incline of each of the first and second wedge-shaped supports 104, 106 has the highest point of the incline at the leading edge 128, 130, respectively, thereof, which is where the infant's arms and head are positioned when on their tummy. Opposite the leading edges 128, 130 is a trailing edge 129, 131, respectively.

Figure 3:
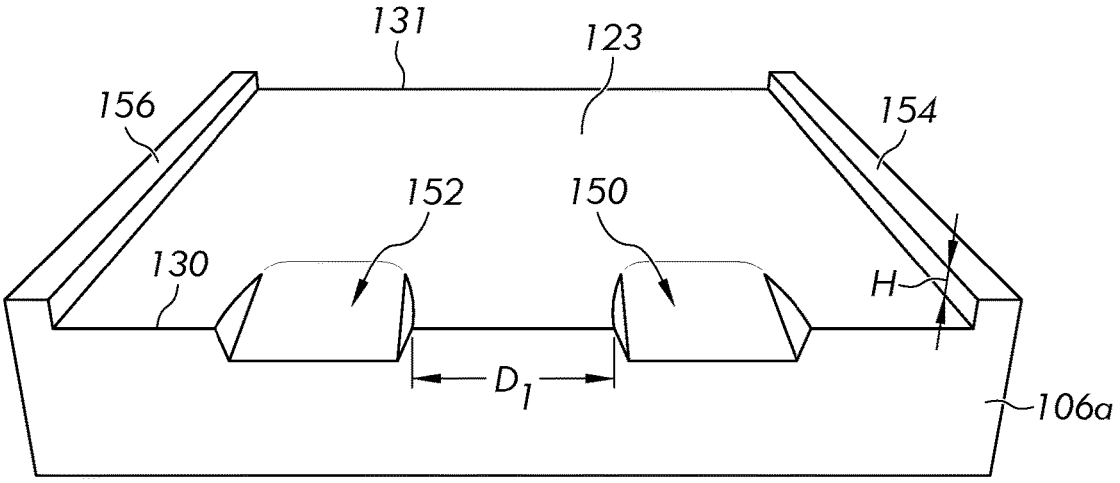
FIG. 3 is a front perspective view of the second wedge-shaped support with the jacket removed therefrom.

Each of the first and second wedge-shaped supports 104, 106 can have a removably replaceable jacket 120, 124 (sleeve, case, etc.) covering their respective wedge-shaped body 104*a*, 106*a* that includes foam defining at least the top surface thereof. Turning now to FIG. 3, the second wedge-shaped support body 106*a* is shown, i.e., the jacket 124 has been removed. In the illustrated embodiment, the second wedge-shaped body 106*a* is made of a single foam layer that has been contoured to have at the leading edge a left arm trough 150 and a right arm trough 152. The left and right arm troughs 150, 152 are spaced apart a pre-selected distance $D_1$ from one another. In one embodiment, $D_1$ is 1.5 to 4 inches. Also, the second wedge-shaped body 106*a* has opposing elongate flanges 154, 156 protruding vertically upward from the top surface 123 running from the leading edge 130 to the trailing edge 131. The elongate flanges 154, 156 have a height H in a range of about 1 inch to about 2 inches and because of the slope of the wedge-shaped support body, H changes along the length of the slope. H can be greater toward the trailing edge 131 than at the leading edge 130. The opposing elongate flanges 154, 156 are positioned at or proximate the left and right sides of the second wedge-shaped body 106*a*.

Figure 5:
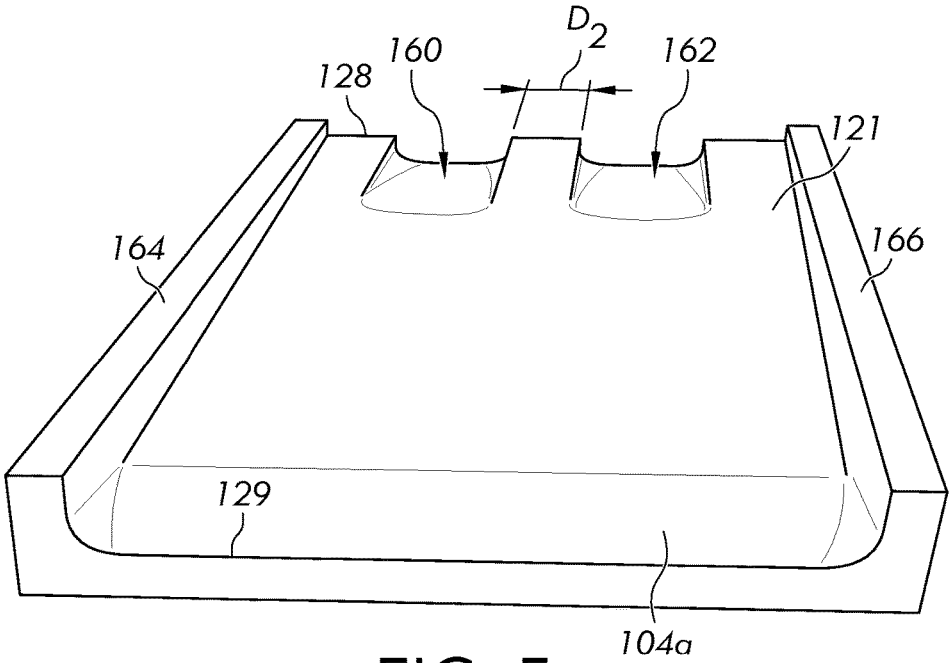
FIG. 5 is a photograph from a rear perspective view of the first wedge-shaped support with the jacket removed therefrom.

Turning now to FIG. 5, the first wedge-shaped support body 104*a* is shown, i.e., the jacket 120 has been removed. In the embodiment shown in the photograph, the first wedge-shaped body 106*a* is made of a single foam layer that has been contoured to have at the leading edge a left arm trough 160 and a right arm trough 162. The left and right arm troughs 150, 152 are spaced apart a pre-selected distance $D_2$ from one another. Typically, $D_2$ is less than (shorter) $D_1$ and the arm troughs 160, 162 are not as deep as those in the second wedge-shaped body 106*a*. The first wedge-shaped body 104*a* has opposing elongate flanges 164, 166 protruding vertically upward from the top surface 121 running from the leading edge 128 to the trailing edge 129. The elongate flanges 164, 166 have a height H in a range of about 1 inch to about 2 inches and because of the slope of the wedge-shaped support body, H changes along the length of the slope. H can be greater toward the trailing edge 131 than at the leading edge 130. The opposing elongate flanges 164, 166 are positioned at or proximate the left and right sides of the second wedge-shaped body 106*a*.

Referring now to FIGS. 6-9, a second embodiment of a wedge-shaped support body 204 is shown from multiple views. This wedge-shaped support body 204 has many of the attributes discussed above for the first embodiment, such as being available in two sizes, each having an incline in the ranges discussed above for infants of different weights and/or ages. The wedge-shaped support 204 has a flat bottom surface 222, a top surface 221 inclined at a first angle in a range of about 8° to about 20° relative to the bottom surface 222, a front side 230 beginning at the leading edge 228 of the incline, a rear side 232 beginning at the trailing edge 229 of the incline. As best seen in the top view of FIG. 7, the front side 230 has two concave recesses 250, 252 positioned proximate shoulder positions of an infant on its tummy prone against the wedge-shaped support body 204 and the rear side 232 has a single elongate concave recess 254 with a peak 256 generally centered between the two concave recesses 250, 254.

Still referring to FIGS. 6-9, the top surface 221 is contoured at the leading edge 228 to define a left arm trough 258 and a right arm trough 260, thereby giving the top surface an undulating contour along the length L thereof, the length L being oriented transverse to the direction of the incline $D_I$. The wedge-shaped support 204 may also have opposing flanges 262, 264 protruding vertically upward from the top surface 221 and running from the leading edge 228 to the trailing edge 229 at positions proximate a left side 266 and a right side 268, respectively. The opposing flanges 262, 264 are arcuate toward the interior of the top surface 221 and provide crests to the undulating contour thereof. The opposing flanges 262, 264 are configured to have a height sufficient to prevent infants from rolling to either the left or the right and off the support. The central portion 270 of the wedge-shaped support body 204, which is between the two concave recesses 250, 252, protrudes beyond the leading edges at the opposing flanges 262, 264.

Figure 8:
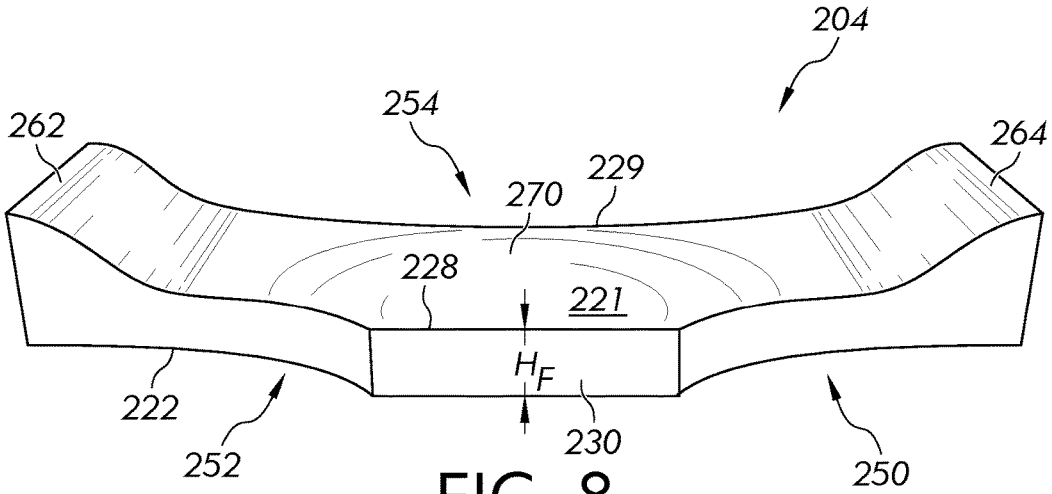
FIG. 8 is a front perspective view of the wedge-shaped support of FIG. 6.

The wedge-shaped support body 204 has a height $H_F$ at a center point relative to the length L as measured from the bottom surface 222 to the top surface 221 at the leading edge 228 as labeled in FIG. 8. The height $H_F$ is in a range of about 1 inch to about 1.5 inches and the height $H_R$ at the opposite point at the trailing edge 229 is in a range of about ¼ inch to about % inch. The wedge-shaped support body 204 has a width W measured at the center of the wedge-shaped support is in a range of about 3 inches to about 4 inches and a length L of the wedge-shaped support is in a range of about 12 inches to about 17 inches. In one embodiment, a first wedge shaped support body 204 has the following dimensions: L=14 in, W=3 in, $H_R$=¼ in, and $H_F$=1 in and a second wedge support has the following dimensions: L=15, W=3½ in, $H_R$=⅓ in, and $H_F$=1¼ in. A kit may include one or both of the first and second wedge-shaped supports 204.

Figure 6:
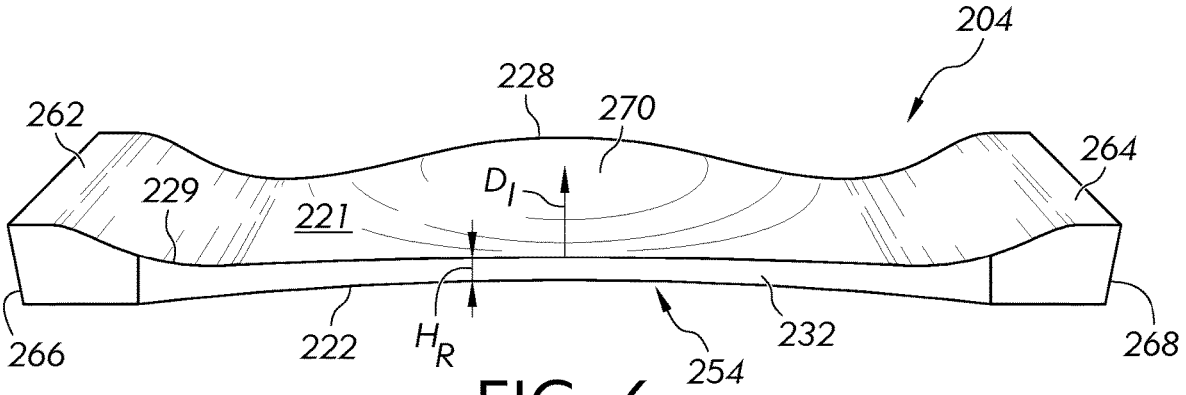
FIG. 6 is a rear perspective view of a second embodiment of a wedge-shaped support.
Figure 7:
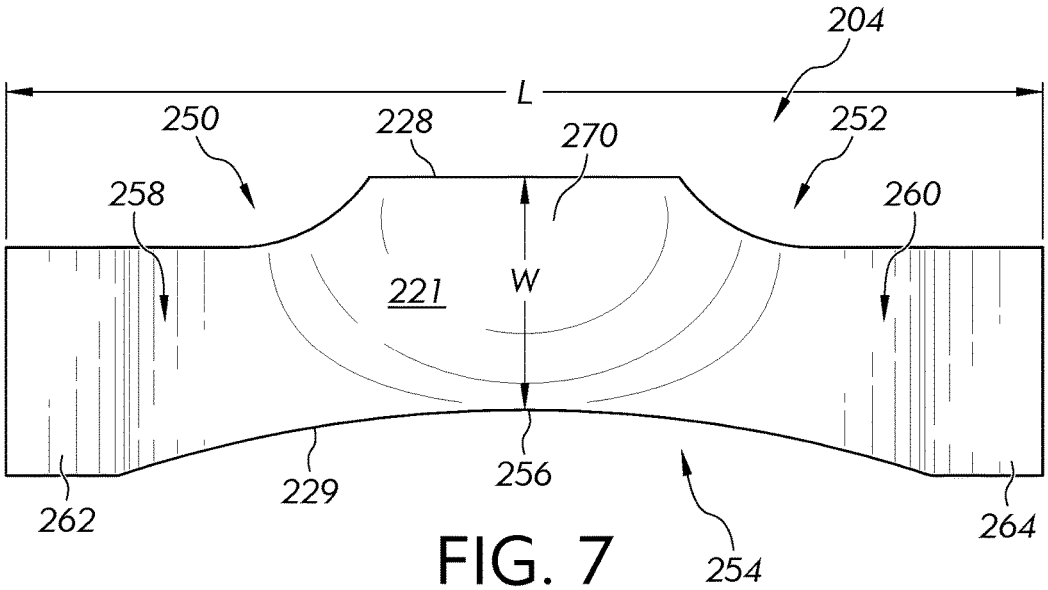
FIG. 7 is a top view of the wedge-shaped support of FIG. 6.

While the foam in FIGS. 6-8 is shown with rough cuts to the top surface to form the desired contours and shape of the support 204, this is not limiting. The top surface, depending on the method of manufacturing, can be smooth, yet contoured and inclined as described herein. For example, the foam may be laser cut, die cut, computer numerical control (CNC) cut, injection molded, and thermoformed, including vacuum forming, encapsulating molding, and compression molding, into the desired shape.

Working Example

A study was completed with twenty-five infants between the ages of 4 weeks and 24 weeks of age and their parent/ legal guardian (18+ yrs. of age). Data collection took place in the participating families' homes via video recording. The infants were between 1 month to 6 months of age with no known sensory, cognitive, or motor impairments as assessed by their parent/legal guardian, no diagnosis of Gastroesophageal reflux disease (GERD), and weigh at least 10 pounds at the time of the tummy time sessions.

Figure 10:
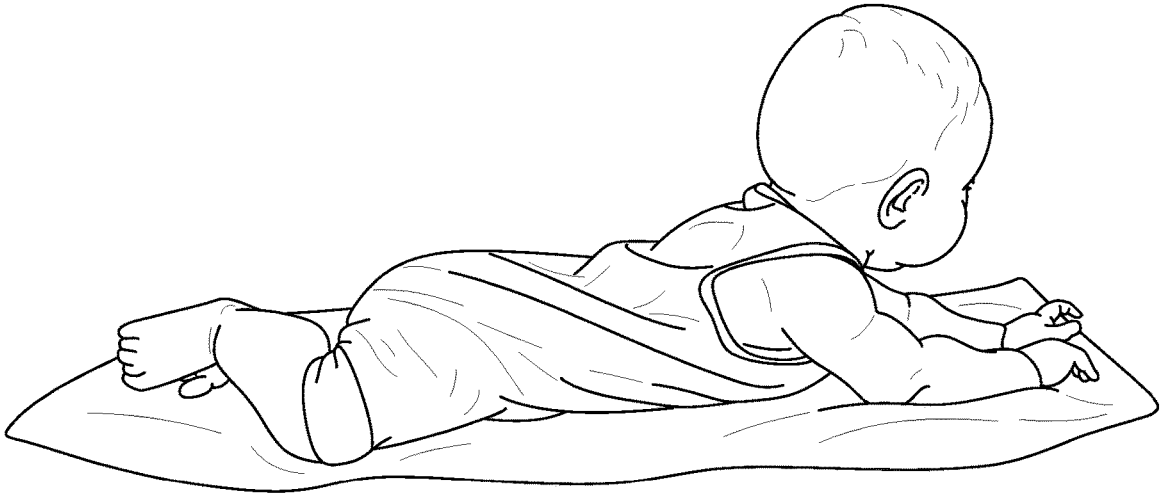
FIG. 10 is photograph of an infant prone on a blanket.
Figure 11:
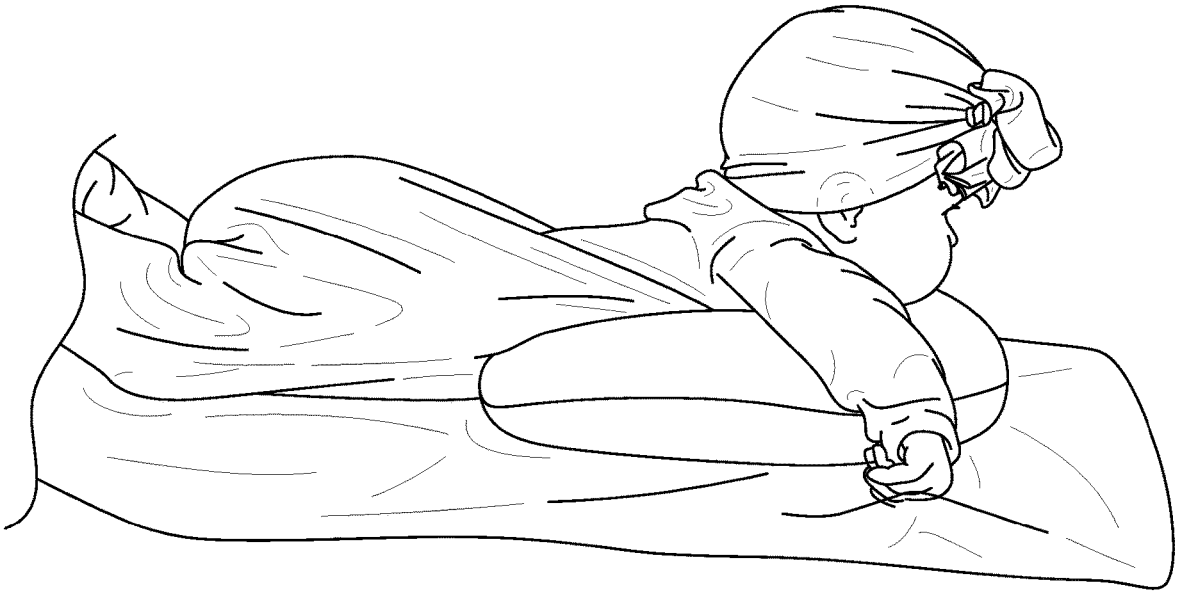
FIG. 11 is a photograph of an infant prone on a C-shaped pillow with a gym of toys.
Figure 12:
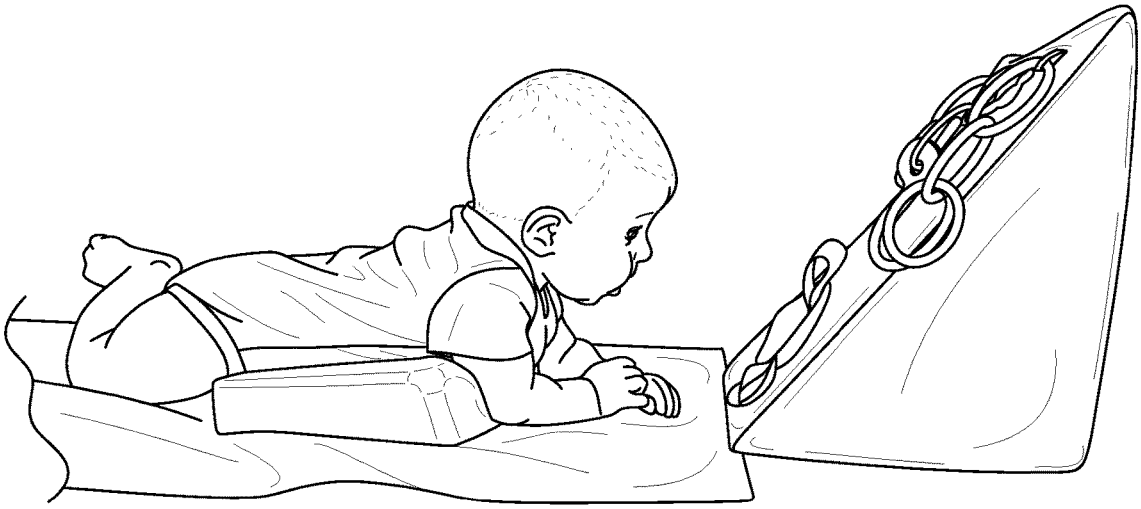
FIG. 12 is a photograph of a first infant prone on the wedge-shaped support of FIG. 6 facing a toy support.
Figure 13:
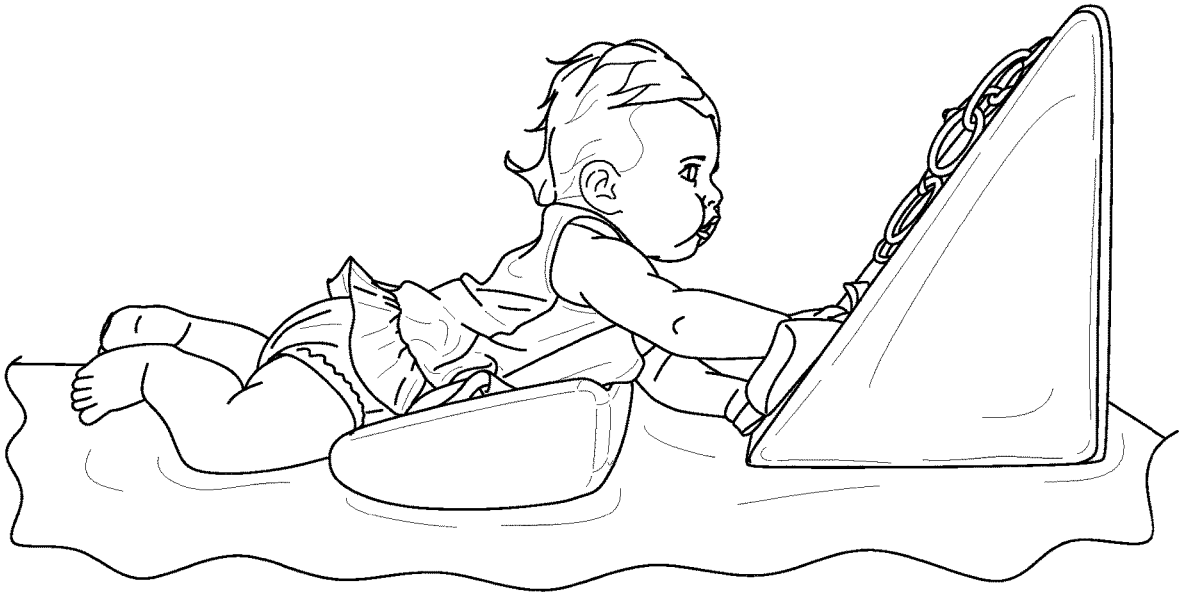
FIG. 13 is a photograph of a first infant prone on the wedge-shaped support of FIG. 6 facing a toy support.

Each infant was evaluated in three positions. A Blanket position which was on their belly on a blanket spread out on a flat surface, such as a floor. See FIG. 10. A C-shaped pillow position, which was a C-shaped prop pillow and accompanying commercially available tummy time activity gym. See FIG. 11. And, an inventive position, which was with their chest positioned on the wedge-shaped support disclosed in FIGS. 6-9 while on a flat surface.

Infants and their parent/guardian were volunteers that were evaluated to meet the above criteria as well the capability to conduct the video recordings and if interested agreed to participate in the study. Each parent/guardian was asked the same interview questions and completed a tummy time questionnaire. Each parent/guardian was educated on the importance of prone sleeping using the AAP Safe Sleep Guidelines and on supervised, wakeful play in a prone position using a brochure from Pathways Awareness.

The participants were randomized into Groups A, B, and C.

TABLE 1

| Group | Day 1 - Position | Day 2 - Position | Day 3 - Position |
|---|---|---|---|
| Group A | Blanket | C-shaped Pillow | Inventive |
| Group B | C-shaped Pillow | Inventive | Blanket |
| Group C | Inventive | Blanket | C-shaped Pillow |

Subsequently, the parents/guardians were instructed to complete three recorded tummy time sessions in the order identified in Table 1 above based on the group to which they were assigned. In each session, the parent was instructed to video-record the infant while positioned in prone in one of the three experimental conditions for at least 5 minutes. The parents were provided with a positioning and recording guide that included directions and example images. A tolerance scale of 0 to 4 points was used to monitor infant tolerance of the position.

| TOLERANCE SCALE | |
|---|---|
| 0 | Sleeping |
| 1 | No signs of distress (content, smiling) |
| 2 | Minor distress (wiggling) |
| 3 | Moderate distress (whimpering, trying to change position) |
| 4 | Maximum distress (crying) |

Recording of a position was to be conducted only when the infant was at a level 1 on the distress scale. The parent/guardian was provided a positioning and recording guide to refer to during each session. The sessions were to be stopped if, the infant reached level 4 on the tolerance scale, if the infant reaches level 3 on the tolerance scale and cannot be comforted within one minute, if the infant is at level 0 on the tolerance scale, or if the session end because of a diaper change or other unforeseen circumstance. If a session was stopped before the infant spent at least 5 minutes in tummy time, the parent/guardian was asked to implement and video-record that session later the same day or the following day, whichever was more convenient. Each position was allowed to be recorded in smaller increments to equal a total of 5 minutes if the baby does not tolerate an uninterrupted 5-minute session. No more than three days was to pass between each successful recording session.

After the three days were successfully completed, the videos of the sessions were provided to the researcher and a follow-up video conference was held.

Qualitative Evaluation: At the end of each successfully recorded session, the parent/guardian answered the following questions, as applicable. Responses were written, typed, or videorecorded.

1) What did your infant appear to enjoy about tummy time using the blanket?
2) What did your infant appear to dislike about tummy time using the blanket?
3) What did your infant appear to enjoy about tummy time using the Infantino play gym?
4) What did your infant appear to dislike about tummy time on the Infantino play gym?
5) What did your infant appear to enjoy about tummy time using the Blanket/Playmat/Wedge System?
6) What did your infant appear to dislike about tummy time on the Blanket/Playmat/Wedge System?
7) If you could change anything about the Wedge System, what would it be?

Data Analysis: Time spent in prone was measured in seconds. The time spent in prone for the three different positions was concatenated for final analysis. Comparisons were made using repeated measures analysis of variance (ANOVA) and repeated measures post hoc comparisons were used to detect significant differences between the three different positions. Significance was set at $\alpha=0.05$. ANOVA is an analysis tool used in statistics that splits an observed aggregate variability found inside a data set into two parts: systematic factors and random factors.

A one-factor within-subjects ANOVA was conducted on n=21 subjects. The design used the inventive position and the C-shaped pillow position as two treatment conditions and the blanket position as the control condition, resulting in a total of three observations per subject. Using the Huynh-Feldt adjustment ($\varepsilon=0.572$) to correct for potential lack of sphericity, the omnibus F test was significant ($F(2,40)=8.98$, $p<0.001$), thus warranting a subsequent post hoc analysis. The post hoc analysis was conducted using the Šidák method with a familywise nominal significance of $a=0.05$. All pairwise comparisons were made among the three means.

The comparison between the inventive position versus C-shaped pillow position ($p<0.001$) and the inventive position versus the blanket position ($p<0.022$) were statistically significant. The inventive position resulted in increased head control as compared to the gym and blanket by 28.5 seconds and 19.4 seconds respectively.

According to observers from the study, the infants showed an improvement in propping themselves up on their elbows to look around on the wedge-shaped support body. Also, the observers reported that the toy support with toys and/or mirror kept the infant's interest and placed toys within easy reach. Importantly, the advantages of the wedge-shaped support boy with its incline are promotion of head control, support of the chest without unnecessary pressure on the armpit area, and weight bearing on elbows and hands.

It should be noted that the embodiments are not limited in their application or use to the details of construction and arrangement of parts and steps illustrated in the drawings and description. Features of the illustrative embodiments, constructions, and variants may be implemented or incorporated in other embodiments, constructions, variants, and modifications, and may be practiced or carried out in various ways. Furthermore, unless otherwise indicated, the terms and expressions employed herein have been chosen for the purpose of describing the illustrative embodiments of the present invention for the convenience of the reader and are not for the purpose of limiting the invention.

Having described the invention in detail and by reference to preferred embodiments thereof, it will be apparent that modifications and variations are possible without departing from the scope of the invention which is defined in the appended claims.

What is claimed is:

1. An infant tummy time kit comprising:

a mat having a first fastener on a top surface thereof; and a first wedge-shaped support having a second fastener on a bottom surface thereof, the second fastener being releasably attachable to the first fastener;

wherein the first wedge-shaped support has a top surface inclined at a first angle in a range of about 8° to about 20° relative to the bottom surface, has an inward arcuate recess generally centrally in a rear surface and has two inward arcuate recesses in a front surface; wherein, in a top view, one of the two inward arcuate recesses is positioned to the left and the other is position to the right of the peak of the inward arcuate recess;

wherein the incline begins at the rear surface extends to the front surface in a central region of the first wedge-shaped support.

2. The kit of claim 1, comprising:

a second wedge-shaped support having a third fastener on a bottom surface thereof, the third fastener being releasably attachable to the first fastener and having a top surface inclined at a second angle; wherein the second angle is in the range of about 8° to about 20° relative to the bottom surface and is at an angle that is greater than the first angle.

3. The kit of claim 2, wherein the first and second wedge-shaped supports comprise a foam material.

4. The kit of claim 1, wherein the mat has a fourth fastener on the top surface thereof positioned a pre-selected distance from a position of a leading edge of the first wedge-shaped support when attached to the mat; wherein the kit comprises a toy support having a fifth fastener on a bottom surface thereof, the fifth fastener being removably attachable to the fourth fastener; wherein the toy support has a first major side comprising a plurality of connectors each connectable to a toy.

5. The kit of claim 4, wherein the toy support has a non-breakable mirror on an opposite side from the first major side; wherein the toy support is attachable to the fourth fastener with either the first major side or the opposite side facing whichever of the first and second wedge-shaped supports is attached to the first fastener.

6. The kit of claim 5, wherein the toy support is wedge-shaped, and the first major side is a sloped incline oriented to position a top of the toy support further from the first or second wedge-shaped support.

7. The kit of claim 6, wherein the opposite side is a vertically upright surface.

8. The kit of claim 4, wherein the first to fifth fasteners are selected from the group consisting of snaps, hook-and-loop fasteners, carabiner clips, and magnets.

9. The kit of claim 1, wherein each of the first and second wedge-shaped supports has a removably replaceable jacket thereover.

10. The kit of claim 1, wherein the top surface of the first wedge-shaped support is contoured at the leading edge to define a left arm trough and a right arm trough, thereby giving the top surface an undulating contour along the length thereof, the length being oriented transverse to the direction of the incline.

11. The kit of claim 10, wherein the first wedge-shaped support has opposing flanges protruding vertically upward from the top surface running from the leading edge to the trailing edge at positions proximate a left side and a right side, respectively.

12. The kit of claim 11, wherein the opposing flanges are arcuate toward the interior of the top surface and provide crests to the undulating contour thereof.

13. The kit of claim 1, further comprising a spacer removably attachable to the mat at a position to space an infant's legs apart, wherein the leg spacer is generally triangularly-shaped.

14. A tummy time support for infants comprising;

a wedge-shaped support having a flat bottom surface, a top surface inclined at a first angle in a range of about 8° to about 20° relative to the bottom surface, a front side at the peak of the incline, a rear side at the base of the incline;

wherein, in a top view, the front side has two concave recesses positioned proximate shoulder positions of an infant on its tummy and the rear side has a single elongate concave recess with a peak centered between the two concave recesses in the front side.

15. The tummy time support of claim 14, wherein the top surface is contoured at the leading edge to define a left arm trough and a right arm trough, thereby giving the top surface an undulating contour along the length thereof, the length being oriented transverse to the direction of the incline.

16. The tummy time support of claim 15, further comprising opposing flanges protruding vertically upward from the top surface running from the leading edge to the trailing edge at positions proximate a left side and a right side, respectively.

17. The tummy time support of claim 15, wherein the opposing flanges are arcuate toward the interior of the top surface and provide crests to the undulating contour thereof.

18. The tummy time support of claim 15, wherein the height at the leading edge is in a range of about 1 inch to about 1.5 inches and the height at the trailing edge is in a range of about ¼ inch to about ¾ inch.

19. The tummy time support of claim 18, wherein a width measured at the center of the wedge-shaped support is in a range of about 3 inches to about 4 inches and a length of the wedge-shaped support is in a range of about 12 inches to about 17 inches.

* * * * *